US006003257A

United States Patent [19]

Stokes

[11] Patent Number: 6,003,257

[45] Date of Patent: Dec. 21, 1999

[54] FLOOR SIGN DEVICE

[76] Inventor: Darrell Stokes, 301 S. Main, Brigham City, Utah 84302

[21] Appl. No.: 09/160,172

[22] Filed: Sep. 25, 1998

[51] Int. Cl.[6] ..... G09F 15/00

[52] U.S. Cl. ..... 40/610; 40/559; 40/455; 40/906; 404/6

[58] Field of Search ..... 40/455, 559, 606, 40/610, 611, 612, 902, 906; 362/812; 116/63 P; 404/6

[56] References Cited

U.S. PATENT DOCUMENTS

| | | | |
|---|---|---|---|
| 3,490,749 | 1/1970 | Anderson | 40/610 X |
| 4,928,415 | 5/1990 | Walters | 40/612 X |
| 4,930,236 | 6/1990 | Hart | 40/455 X |
| 4,999,937 | 3/1991 | Bechtold | 40/612 X |
| 5,467,076 | 11/1995 | Ruocco et al. | 40/606 X |
| 5,570,972 | 11/1996 | Glass et al. | 404/6 |
| 5,621,992 | 4/1997 | Mandell et al. | 40/539 X |
| 5,729,215 | 3/1998 | Jutras | 116/638 X |
| 5,920,634 | 7/1999 | Chiquette | 40/455 X |

FOREIGN PATENT DOCUMENTS

| | | | |
|---|---|---|---|
| 2232520 | 12/1990 | United Kingdom | 40/906 |

*Primary Examiner*—Brian K. Green

[57] ABSTRACT

A floor sign device for use on wet, newly waxed, and painted floors to warn and caution pedestrians travelling on the floor of the surface conditions. The device includes first and second panels pivotally coupled together along their top edges. An elongate light tower extends from the top edges of the panels with a light source mounted to the upper end of the light tower. A sound recording and playing device is provided in the light tower. The sound recording and playing device has a microphone and a speaker on the light tower. A motion detecting sensor for detecting motion from a nearby pedestrian is also provided on the light tower. The motion detecting sensor is electrically connected to light source and the sound recording and playing device. The light source is activated to illuminate and the sound recording and playing device is activated to project an audible prerecorded warning when the motion detecting sensor detects motion from a nearby pedestrian.

9 Claims, 2 Drawing Sheets

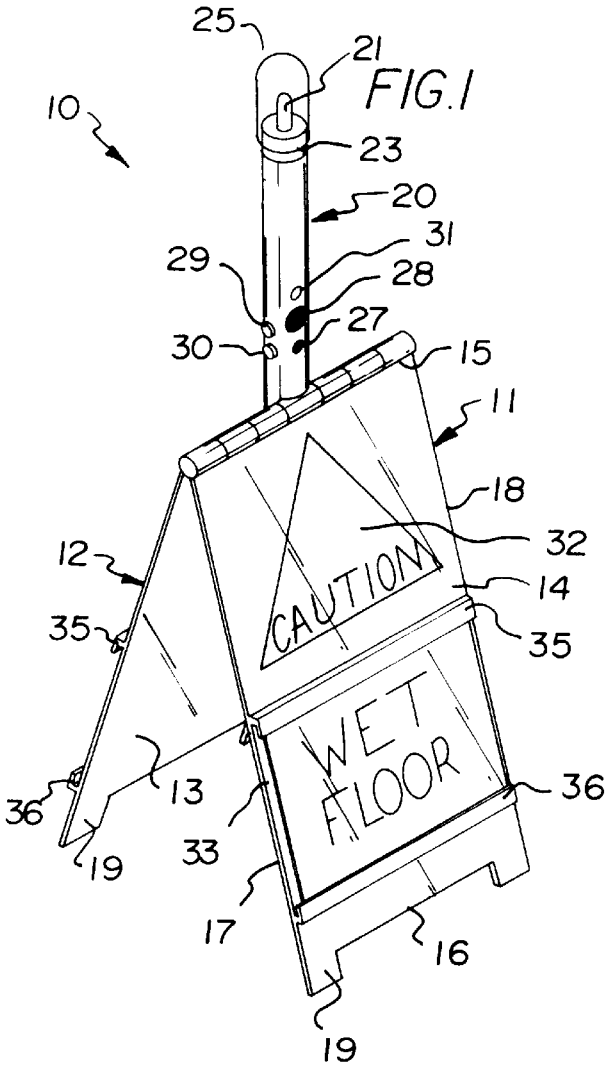
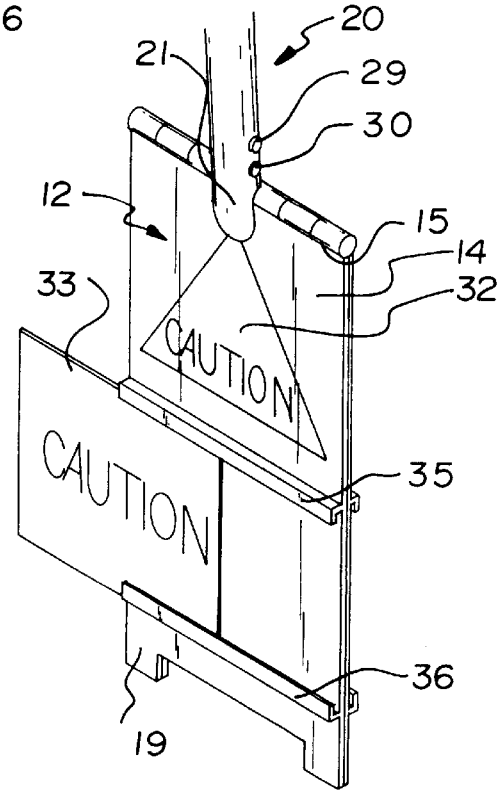
FIG.2

FLOOR SIGN DEVICE

BACKGROUND OF THE INVENTION

1. Field of the Invention

The present invention relates to floor sign devices and more particularly pertains to a new floor sign device for use on wet, newly waxed, and painted floors to warn and caution pedestrians travelling on the floor of the surface conditions.

2. Description of the Prior Art

The use of floor sign devices is known in the prior art. More specifically, floor sign devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,729,215; U.S. Pat. No. 4,796,369; U.S. Pat. No. Des. 328,615; U.S. Pat. No. 5,382,112; U.S. Pat. No. 4,859,983; and U.S. Pat. No. 2,486,655.

While these devices fulfill their respective, particular objectives and requirements, the aforementioned patents do not disclose a new floor sign device. The inventive device includes first and second panels pivotally coupled together along their top edges. An elongate light tower extends from the top edges of the panels with a light source mounted to the upper end of the light tower. A sound recording and playing device is provided in the light tower. The sound recording and playing device has a microphone and a speaker on the light tower. A motion detecting sensor for detecting motion from a nearby pedestrian is also provided on the light tower. The motion detecting sensor is electrically connected to light source and the sound recording and playing device. The light source is activated to illuminate and the sound recording and playing device is activated to project an audible prerecorded warning when the motion detecting sensor detects motion from a nearby pedestrian.

In these respects, the floor sign device according to the present invention substantially departs from the conventional concepts and designs of the prior art, and in so doing provides an apparatus primarily developed for the purpose of use on wet, newly waxed, and painted floors to warn and caution pedestrians travelling on the floor of the surface conditions.

SUMMARY OF THE INVENTION

In view of the foregoing disadvantages inherent in the known types of floor sign devices now present in the prior art, the present invention provides a new floor sign device construction wherein the same can be utilized for use on wet, newly waxed, and painted floors to warn and caution pedestrians travelling on the floor of the surface conditions.

The general purpose of the present invention, which will be described subsequently in greater detail, is to provide a new floor sign device apparatus and method which has many of the advantages of the floor sign devices mentioned heretofore and many novel features that result in a new floor sign device which is not anticipated, rendered obvious, suggested, or even implied by any of the prior art floor sign devices, either alone or in any combination thereof.

To attain this, the present invention generally comprises first and second panels pivotally coupled together along their top edges. An elongate light tower extends from the top edges of the panels with a light source mounted to the upper end of the light tower. A sound recording and playing device is provided in the light tower. The sound recording and playing device has a microphone and a speaker on the light tower. A motion detecting sensor for detecting motion from a nearby pedestrian is also provided on the light tower. The motion detecting sensor is electrically connected to light source and the sound recording and playing device. The light source is activated to illuminate and the sound recording and playing device is activated to project an audible prerecorded warning when the motion detecting sensor detects motion from a nearby pedestrian.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new floor sign device apparatus and method which has many of the advantages of the floor sign devices mentioned heretofore and many novel features that result in a new floor sign device which is not anticipated, rendered obvious, suggested, or even implied by any of the prior art floor sign devices, either alone or in any combination thereof.

It is another object of the present invention to provide a new floor sign device which may be easily and efficiently manufactured and marketed.

It is a further object of the present invention to provide a new floor sign device which is of a durable and reliable construction.

An even further object of the present invention is to provide a new floor sign device which is susceptible of a low cost of manufacture with regard to both materials and labor, and which accordingly is then susceptible of low prices of sale to the consuming public, thereby making such floor sign device economically available to the buying public.

Still yet another object of the present invention is to provide a new floor sign device which provides in the apparatuses and methods of the prior art some of the advantages thereof, while simultaneously overcoming some of the disadvantages normally associated therewith.

Still another object of the present invention is to provide a new floor sign device for use on wet, newly waxed, and painted floors to warn and caution pedestrians travelling on the floor of the surface conditions.

Yet another object of the present invention is to provide a new floor sign device which includes first and second panels pivotally coupled together along their top edges. An elongate light tower extends from the top edges of the panels with a light source mounted to the upper end of the light tower. A sound recording and playing device is provided in the light tower. The sound recording and playing device has a microphone and a speaker on the light tower. A motion detecting sensor for detecting motion from a nearby pedestrian is also provided on the light tower. The motion detecting sensor is electrically connected to light source and the sound recording and playing device. The light source is activated to illuminate and the sound recording and playing device is activated to project an audible prerecorded warning when the motion detecting sensor detects motion from a nearby pedestrian.

Still yet another object of the present invention is to provide a new floor sign device that lets a user change the warnings displayed thereon as desired to alert pedestrians to various hazards.

Even still another object of the present invention is to provide a new floor sign device that provides an audible voice warning when pedestrians pass nearby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new floor sign device in a deployed position to be rested on a floor surface according to the present invention.

FIG. 2 is a schematic perspective view of the present invention with the panels folded together.

DESCRIPTION OF THE PREFERRED EMBODIMENT

Figure 3:
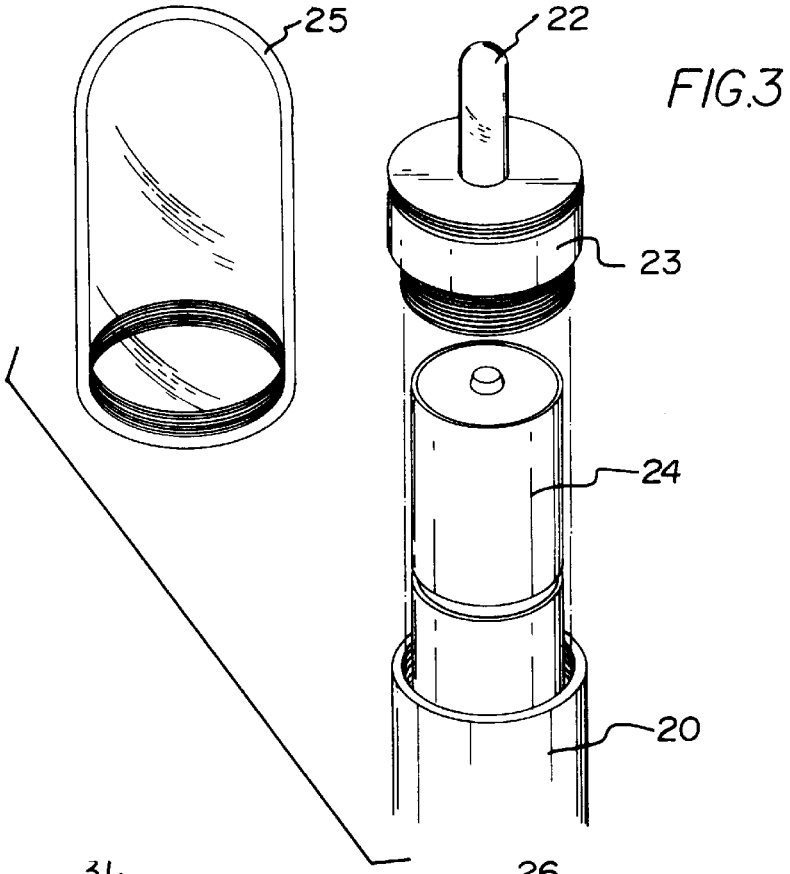
FIG. 3 is a schematic exploded partial perspective view of the upper end of the light tower of the present invention.
Figure 4:
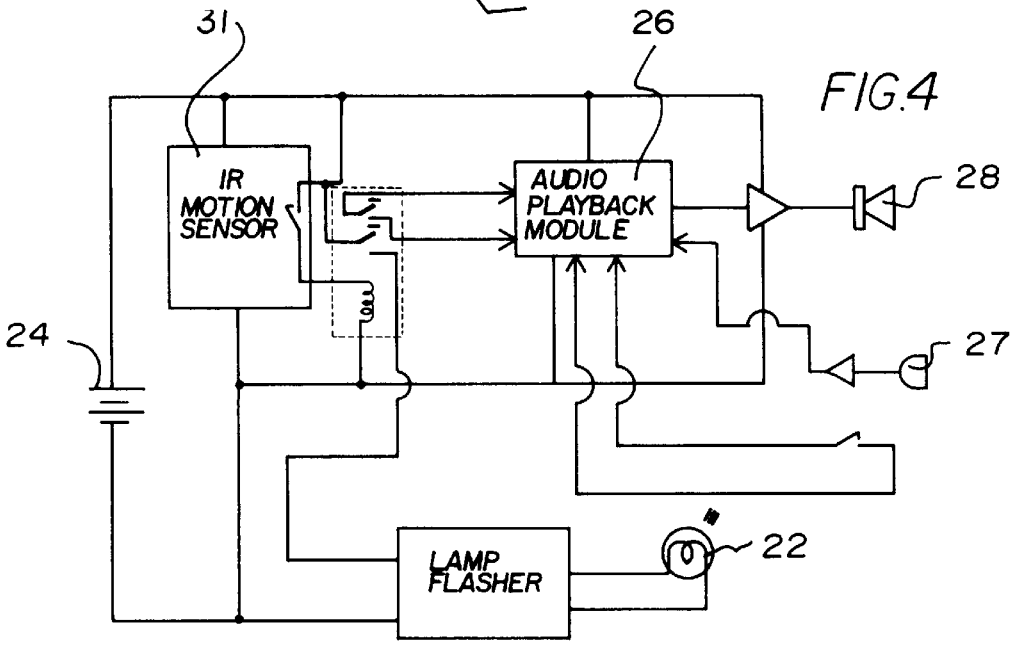
FIG. 4 is an electrical schematic of the present invention.

With reference now to the drawings, and in particular to FIGS. 1 through 4 thereof, a new floor sign device embodying the principles and concepts of the present invention and generally designated by the reference numeral 10 will be described.

As best illustrated in FIGS. 1 through 4, the floor sign device 10 generally comprises first and second panels 11,12 pivotally coupled together along their top edges 15. An elongate light tower 20 extends from the top edges 15 of the panels 11,12 with a light source 22 mounted to the upper end of the light tower 20. A sound recording and playing device 26 is provided in the light tower 20. The sound recording and playing device 26 has a microphone 27 and a speaker 28 on the light tower 20. A motion detecting sensor 31 for detecting motion from a nearby pedestrian is also provided on the light tower 20. The motion detecting sensor 31 is electrically connected to light source 22 and the sound recording and playing device 26. The light source 22 is activated to illuminate and the sound recording and playing device 26 is activated to project an audible prerecorded warning when the motion detecting sensor 31 detects motion from a nearby pedestrian.

In closer detail, the floor sign device 10 is designed for resting on a floor surface to warn pedestrians of the conditions of the floor surface. Specifically, the floor sign device 10 includes first and second panels 11,12 each being generally rectangular in configuration and each having generally planar inner and outer faces 13,14, top and bottom edges 15,16, and a pair of generally straight side edges 17,18 extending between the top and bottom edges 15,16 of the respective panel. The top edges 15 of the first and second panels 11,12 are pivotally coupled together by a hinge extending substantially across their lengths between the side edges 17,18 of the panels 11,12 so that the inner faces 13 of the first and second panels 11,12 face one another when the panels 11,12 are folded together as illustrated in FIG. 2. The bottom edge 16 of each of the panels 11,12 preferably has a generally rectangular cutout forming a spaced apart pair of resting feet 19 outwardly extending therefrom. In use, the resting feet 19 are designed for resting on a floor surface. One of the resting feet of each of the panels is positioned adjacent one of the side edges of the respective panel while another of the resting feet of each of the panels is positioned adjacent another of the side edges of the respective panel.

The elongate light tower 20 upwardly extends from the top edges 15 of the panels 11,12. The light tower 20 has a generally cylindrical configuration with upper and lower ends, a generally cylindrical exterior side surface, and a longitudinal axis extending between the upper and lower ends of the light tower 20. The lower end of the light tower 20 is pivotally coupled to the top edges 15 of the panels 11,12. As illustrated in FIG. 2, the lower end of the light tower 20 has an outwardly extending stop 21 adjacent the outer face 14 of second panel 12. In use, the stop 21 of the light tower 20 prevents pivoting of the second panel 12 away from the first panel 11 beyond a predetermined angle formed between the first and second panels 11,12. Preferably, the longitudinal axis of the light tower 20 extends generally perpendicular to the floor surface when the first and second panels 11,12 are pivoted to the predetermined angle and the resting feet 19 are rested on the floor surface.

A light source 22 is mounted to the upper end of the light tower 20. In use, the light source 22 is designed for providing a visual light warning to nearby pedestrians. The light source 22 preferably has a base portion 23 threadably inserted into a threaded opening in the upper end of the light tower 20. The light source 22 preferably comprises a strobe light source 22 for providing a flashing visual warning to nearby pedestrians. As illustrated in FIG. 3, a battery power source 24 is provided in the upper end of the light tower 20. The battery power source 24 is electrically connected to the light source 22 for providing electrical power to the light source 22. A protective dome 25 is threadably mounted to the base portion 23 of the light source 22 to substantially enclose the light source 22. The protective dome 25 comprises a translucent material such as a translucent glass or plastic material. Ideally, the protective dome 25 comprises a generally transparent material.

The sound recording and playing device 26 is designed for recording and playing back audible sounds such a verbal warnings. The sound recording and playing device 26 is provided in the light tower 20. The sound recording and playing device 26 has a microphone 27 for receiving audible signals. The microphone 27 of the sound recording and playing device 26 is provided on the exterior side surface of the light tower 20 between the upper and lower ends of the light tower 20. The sound recording and playing device 26 has a speaker 28 for audibly projecting played recorded sounds. The speaker 28 of the sound recording and playing device 26 is also provided on exterior side surface of the light tower 20 between the upper and lower ends. The sound recording and playing device 26 preferably has a recording switch 29 provided on the exterior side surface of the light tower 20 for activating the sound recording and playing device 26 to record an audible warning message. In this preferred embodiment, the sound recording and playing device 26 also has a play switch 30 provided on the exterior side surface of the light tower 20 for activating the sound recording and playing device 26 to play back the recorded audible warning message.

A motion detecting sensor 31 for detecting motion from a nearby pedestrian is provided on the exterior side surface of the light tower 20 between the upper and lower ends of the light tower 20. Ideally, the motion detecting sensor 31 is located above the microphone 27 and speaker 28 on the light tower 20. The motion detecting sensor 31 is electrically connected to light source 22 and the sound recording and playing device 26. In use, when the motion detecting sensor 31 detects motion from a nearby pedestrian, the light source 22 is activated to illuminate and to flash and the sound recording and playing device 26 is activated to project an audible prerecorded warning.

The outer faces 14 of the first and second panels 11,12 each have a warning design 32 which may include shapes, symbols, and indicia provided thereon for providing a visual warning to nearby pedestrians. The warning designs 32 of the panels 11,12 are positioned towards the top edges 15 of the panels 11,12. The outer faces 14 of the first and second panels 11,12 each also have a generally rectangular placard 33 mounted thereto beneath the warning design 32. Each placard 33 has warning indicia 34 for providing a visible warning to nearby pedestrians. Preferably, the outer faces 14 of the first and second panels 11,12 each have spaced apart upper and lower mounting brackets 35,36 extending between the side edges 17,18 of the respective panel. The mounting brackets 35,36 each have a generally L-shaped transverse cross section taken generally parallel to the side edges 17,18 of the respective panel defining an elongate channel. The channels of each pair of associated mounting brackets 35,36 face on another. Each of the placards 33 is slidably inserted into the channels of the associated mounting brackets 35,36 of the respective panel to mount each placard 33 the respective panel.

In an ideal illustrative embodiment, the floor sign device has a length defined between the protective dome 25 and the resting feet 19 of about 3 feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor sign device, comprising:

first and second panels each having inner and outer faces, top and bottom edges, and a pair of side edges extending between said top and bottom edges of a respective panel;

said top edges of said first and second panels being pivotally coupled together;

said bottom edge of each of said panels being adapted for resting on a floor surface;

an elongate light tower extending from said top edges of said panels, said light tower having upper and lower ends, and a longitudinal axis extending between said upper and lower ends of said light tower;

a light source being mounted to said upper end of said light tower;

a sound recording and playing device for recording and playing audible sounds, said sound recording and playing device being provided in said light tower, said sound recording and playing device having a microphone for receiving audible signals, said microphone of said sound recording and playing device being provided on said light tower, said sound recording and playing device having a speaker for audibly projecting played recorded sounds, said speaker of said sound recording and playing device being provided on said light tower;

a motion detecting sensor for detecting motion from a nearby pedestrian, said motion detecting sensor being provided on said light tower; and said motion detecting sensor being electrically connected to said light source and said sound recording and playing device, wherein said light source is activated to illuminate and said sound recording and playing device is activated to project an audible prerecorded warning when said motion detecting sensor detects motion from a nearby pedestrian.

2. The floor sign device of claim 1, wherein said bottom edge of each of said panels has a spaced apart pair of resting feet outwardly extending therefrom, said resting feet being adapted for resting on a floor surface.

3. The floor sign device of claim 1, wherein said lower end of said light tower is coupled to said top edges of said panels, and wherein said lower end of said light tower has an outwardly extending stop adjacent said outer face of said second panel, said stop of said light tower preventing pivoting of said second panel away from said first panel beyond a predetermined angle formed between said first and second panels, wherein said longitudinal axis of said light tower is adapted to extend generally perpendicular to the floor surface when said first and second panels are pivoted to said predetermined angle and said resting feet are rested on the floor surface.

4. The floor sign device of claim 1, wherein said light source has a base portion threadably inserted into said upper end of said light tower.

5. The floor sign device of claim 1, further comprising a protective dome being mounted to said base portion of said light source to substantially enclose said light source, said protective dome comprising a translucent material.

6. The floor sign device of claim 1, wherein said outer faces of said first and second panels each have a warning design provided thereon for providing a visual warning to nearby pedestrians, said warning designs of said panels being positioned towards said top edges of said panels.

7. The floor sign device of claim 6, wherein said outer faces of said first and second panels each have a generally rectangular placard mounted thereto, each placard having warning indicia for providing a visible warning to nearby pedestrians.

8. The floor sign device of claim 7, wherein said outer faces of said first and second panels each have spaced apart upper and lower mounting brackets extending between said side edges of the respective panel, said mounting brackets each having a generally L-shaped transverse cross section defining an elongate channel, said channel of each pair of associated mounting brackets facing one another, each of said placards being slidably inserted into said channels of associated mounting brackets of the respective panel to mount each placard.

9. A floor sign device, comprising:

first and second panels each being generally rectangular in configuration and each having generally planar inner and outer faces, top and bottom edges, and a pair of generally straight side edges extending between said top and bottom edges of a respective panel;

said top edges of said first and second panels being pivotally coupled together;

said bottom edge of each of said panels having a spaced apart pair of resting feet outwardly extending therefrom, said resting feet being adapted for resting on a floor surface;

one of said resting feet of each of said panels being positioned adjacent one of said side edges of the respective panel, another of said resting feet of each of said panels being positioned adjacent another of said side edges of the respective panel;

an elongate light tower generally cylindrical configuration extending from said top edges of said panels, said light tower having upper and lower ends, and a longitudinal axis extending between said upper and lower ends of said light tower;

said lower end of said light tower being coupled to said top edges of said panels, said lower end of said light tower having an outwardly extending stop adjacent said outer face of said second panel, said stop of said light tower preventing pivoting of said second panel away from said first panel beyond a predetermined angle formed between said first and second panels, wherein said longitudinal axis of said light tower is adapted to extend generally perpendicular to the floor surface when said first and second panels are pivoted to said predetermined angle and said resting feet are rested on the floor surface;

a light source being mounted to said upper end of said light tower, said light source having a base portion threadably inserted into said upper end of said light tower;

wherein said light source comprises a strobe light source;

a protective dome being threadably mounted to said base portion of said light source to substantially enclose said light source, said protective dome comprising a translucent material;

a sound recording and playing device for recording and playing audible sounds, said sound recording and playing device being provided in said light tower, said sound recording and playing device having a microphone for receiving audible signals, said microphone of said sound recording and playing device being provided on said light tower between said upper and lower ends of said light tower, said sound recording and playing device having a speaker for audibly projecting played recorded sounds, said speaker of said sound recording and playing device being provided on said light tower between said upper and lower ends;

a motion detecting sensor for detecting motion from a nearby pedestrian, said motion detecting sensor being provided on said light tower between said upper and lower ends of said light tower;

said motion detecting sensor being electrically connected to said light source and said sound recording and playing device, wherein said light source is activated to illuminate and said sound recording and playing device is activated to project an audible prerecorded warning when said motion detecting sensor detects motion from a nearby pedestrian;

said outer faces of said first and second panels each having a warning design provided thereon for providing a visual warning to nearby pedestrians, said warning designs of said panels being positioned towards said top edges of said panels;

said outer faces of said first and second panels each having a generally rectangular placard mounted thereto, each placard having warning indicia for providing a visible warning to nearby pedestrians;

wherein said outer faces of said first and second panels each have spaced apart upper and lower mounting brackets extending between said side edges of the respective panel, said mounting brackets each having a generally L-shaped transverse cross section defining an elongate channel, said channel of each pair of associated mounting brackets facing one another; and each of said placards being slidably inserted into said channels of associated mounting brackets of the respective panel to mount each placard.

* * * * *